US006510701B2

(12) United States Patent
Kato et al.

(10) Patent No.: US 6,510,701 B2
(45) Date of Patent: Jan. 28, 2003

(54) EXPANSION VALVE WITH VIBRATION-PROOF MEMBER

(75) Inventors: Mitsutoshi Kato, Toyota (JP); Yasuhiro Sato, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/932,206

(22) Filed: Aug. 17, 2001

(65) Prior Publication Data

US 2002/0023462 A1 Feb. 28, 2002

(30) Foreign Application Priority Data

Aug. 22, 2000 (JP) ..... 2000-251309

(51) Int. Cl.[7] ..... F25B 41/04
(52) U.S. Cl. ..... 62/225; 236/92 B; 181/207
(58) Field of Search ..... 62/225, 296; 236/92 B; 181/207, 208, 209; 251/54

(56) References Cited

U.S. PATENT DOCUMENTS 2,573,522 A * 10/1951 Watt ..... 137/79
3,079,277 A * 2/1963 Painter ..... 106/415
5,715,705 A * 2/1998 Kujirai et al. ..... 62/225
5,732,570 A 3/1998 Tomatsu et al.
5,961,038 A * 10/1999 Okada ..... 236/92 B
5,996,900 A * 12/1999 Ise ..... 236/92 B

FOREIGN PATENT DOCUMENTS

| | | |
|---|---|---|
| EP | 0 713 063 A1 | 5/1996 |
| JP | U-55-152875 | 4/1954 |
| JP | U-60-113479 | 7/1985 |
| JP | A 8-135841 | 5/1996 |
| JP | A-9-303905 | 11/1997 |

* cited by examiner

*Primary Examiner*—William E. Tapolcai
*Assistant Examiner*—Mohammad M. Ali
(74) *Attorney, Agent, or Firm*—Harness, Dickey & Pierce, PLC

(57) ABSTRACT

In an expansion valve of a refrigerant cycle, only by covering a diaphragm case and a part of a body case using a single vibration-proof member made of a rubber material, vibration in the diaphragm case can be effectively restricted. Because it is unnecessary to cover all surface of the expansion valve, the dimension of the vibration-proof member can be greatly reduced, and pipe connecting/removing operation in the expansion valve can be readily performed. Accordingly, a material cost of the vibration-proof member can be reduced, while noise caused due to the vibration of the expansion valve can be effectively reduced.

12 Claims, 4 Drawing Sheets

EXPANSION VALVE WITH VIBRATION-PROOF MEMBER

CROSS-REFERENCE TO RELATED APPLICATION

This application is related to Japanese Patent Application No. 2000-251309 filed on Aug. 22, 2000, the contents of which are hereby incorporated by reference.

BACKGROUND OF THE INVENTION

1. Field of the Invention

The present invention relates to an expansion valve which adjusts a flow amount of refrigerant flowing into an evaporator so that a super-heating degree of refrigerant at an outlet of the evaporator is maintained at a predetermined value in a refrigerant cycle. More particularly, the present invention relates to a noise reduction due to a vibration-proof member of the expansion valve.

2. Description of Related Art

In JP-A-9-303905, an insulator is attached to a refrigerant outlet pipe of an expansion valve, so that a vibration in the refrigerant outlet pipe connected to the expansion valve is restricted. However, in this case, because the vibration caused in the expansion valve cannot be restricted, it is impossible to sufficiently reduce noise generated in the expansion valve.

SUMMARY OF THE INVENTION

In view of the foregoing problems, it is an object of the present invention to provide an expansion valve, in which a material cost of a vibration-proof member can be reduced and pipe operation performance can be improved, while a sufficient noise-reducing effect can be maintained.

According to the present invention, in an expansion valve for a refrigerant cycle including an evaporator for evaporating refrigerant, the expansion valve is disposed to adjust an amount of refrigerant flowing into the evaporator so that a super-heating degree of refrigerant at an outlet side of the evaporator becomes a predetermined value. In the expansion valve, a body case has therein a restriction passage for decompressing and expanding high-pressure side liquid refrigerant in the refrigerant cycle, a valve body is disposed in the body case for adjusting an opening degree of the restriction passage, a diaphragm case is disposed at one end side of the body case, a diaphragm is disposed in the diaphragm case to partition a first pressure chamber and a second pressure chamber in the diaphragm case and to displace the valve body in accordance with a pressure difference between both the first and second pressure chambers, and a single vibration-proof member made of a rubber material is disposed to cover only a part of the body case and the diaphragm case. Because the vibration-proof member is provided to cover the diaphragm case, vibration in the diaphragm case can be restricted by the weight of the vibration-proof member. In addition, the diaphragm case is connected to the body case by the vibration-proof member, a free vibration of the diaphragm case can be effectively restricted.

Because the vibration-proof member covers only a part of the vibration-proof member and the diaphragm case, a surface dimension of the vibration-proof member can be greatly reduced as compared with a case where the vibration-proof member covers all the expansion valve, while the vibration in the diaphragm case can be sufficiently reduced.

Preferably, the body case has a width dimension in a direction corresponding to the width of the vibration-proof member, and the width dimension of the body case is larger than the width of the vibration-proof member. Therefore, the vibration-proof member can be readily bonded onto the diaphragm case and the body case.

The expansion valve is a box type in which the body case is connected to a refrigerant pipe through which refrigerant flows, at one side in a width direction, and the vibration-proof member is disposed to be bonded onto the diaphragm case and a part of opposite side surfaces df the body case in a direction approximately perpendicular to the width direction and an extending direction of the body case. Accordingly, the refrigerant pipe can be readily connected to or detached from the body case, in the expansion valve. As a result, material cost of the vibration-proof member can be reduced and pipe operation performance can be improved, while a sufficient noise-reducing effect can be maintained in the expansion valve.

BRIEF DESCRIPTION OF THE DRAWINGS

Additional objects and advantages of the present invention will be more readily apparent from the following detailed description of a preferred embodiment when taken together with the accompanying drawings, in which.

DETAILED DESCRIPTION OF THE PRESENTLY PREFERRED EMBODIMENT

Figure 1:
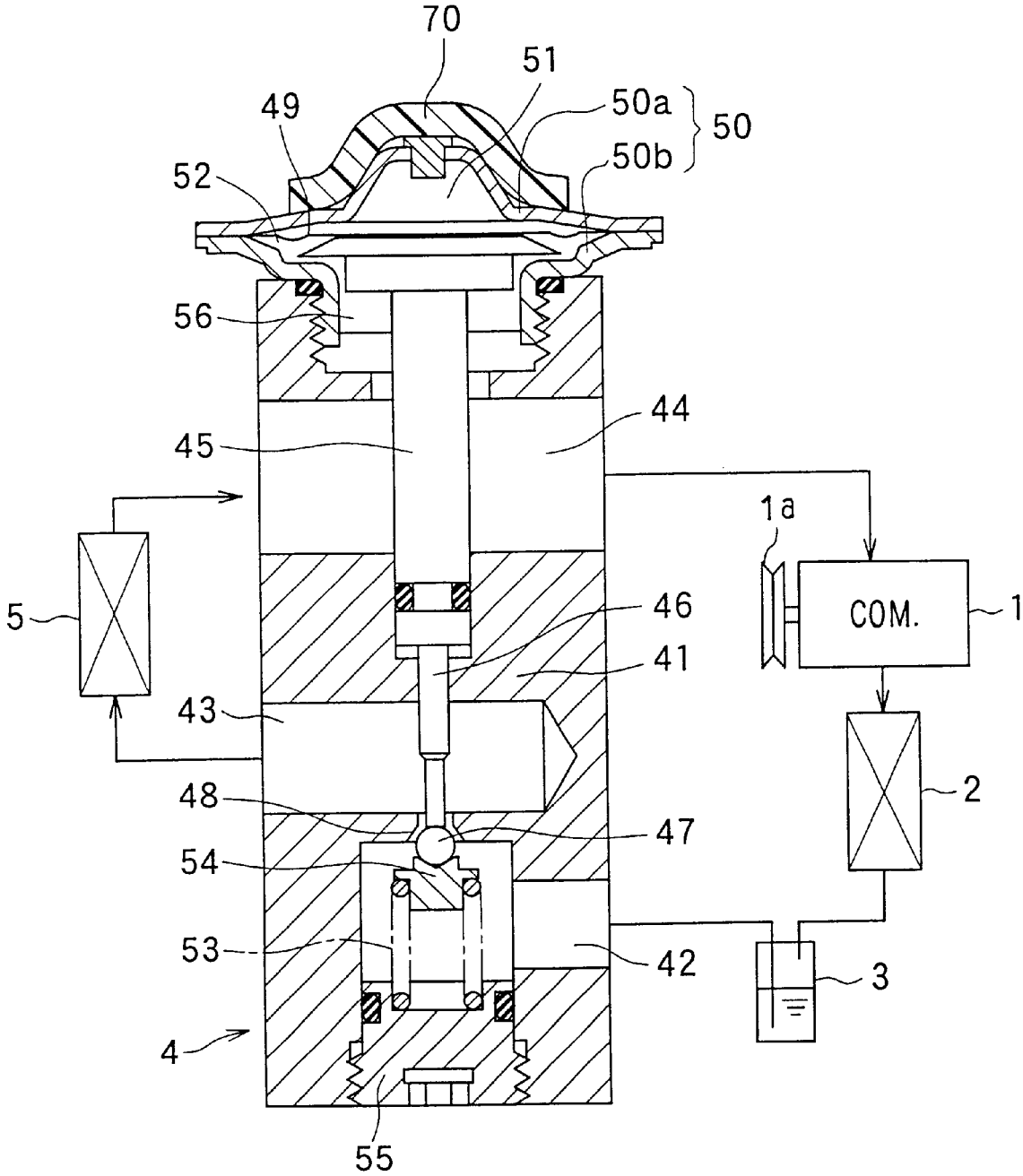
FIG. 1 is a schematic diagram showing a refrigerant cycle including an expansion valve according to a preferred embodiment of the present invention.
Figure 2:
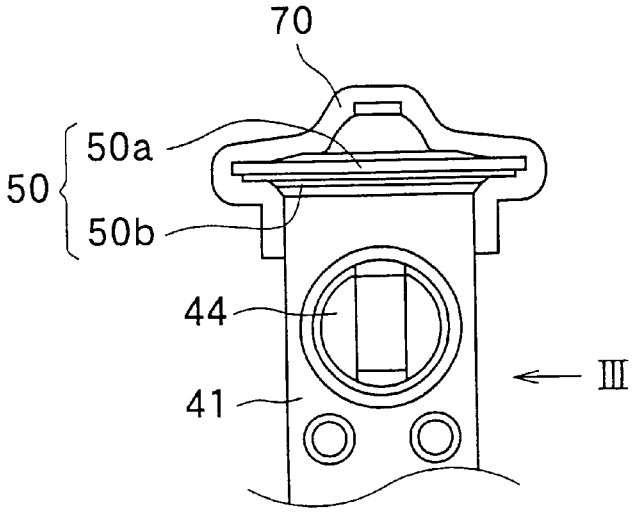
FIG. 2 is a side view showing a part of the expansion valve in FIG. 1.

A preferred embodiment of the present invention will be described hereinafter with reference to the accompanying drawings. In this embodiment, the present invention is typically applied to a thermal expansion valve 4 for a refrigerant cycle of a vehicle air conditioner. A compressor 1 of the refrigerant cycle shown in FIG. 1 is driven by a vehicle engine (not shown) through an electromagnetic clutch 1*a*. Gas refrigerant compressed and discharged by the compressor 1 is cooled and condensed in a condenser 2 by a cooling air (outside air) blown by a cooling fan. Refrigerant condensed in the condenser 2 is introduced into a receiver 3 to be separated into gas refrigerant and liquid refrigerant in the receiver 3. Separated liquid refrigerant is introduced from the receiver 3 into the thermal expansion valve 4, and is decompressed and expanded in the thermal expansion valve 4. Thereafter, refrigerant is introduced from the thermal expansion valve 4 into an evaporator 5. The evaporator 5 is disposed in an air conditioning case of an air conditioning unit so that air blown by a blower is cooled and dehumidified in the evaporator 5.

A valve opening degree of the thermal expansion valve 4 is adjusted so that a super-heating degree of refrigerant at an outlet of the evaporator 5 is maintained at a predetermined degree. The expansion valve 4 and the evaporator 5 are generally disposed in a passenger compartment of a vehicle.

The thermal expansion valve 4 has a body case 41 made of a metal such as aluminum. The body case 41 of the expansion valve 4 is formed approximately into a rectangular parallelopiped shape elongated vertically. Within the body case 41, a high-pressure side liquid-refrigerant passage 42, a low-pressure side two-phase refrigerant passage 43 and a low-pressure side gas-refrigerant passage 44 are provided.

The high-pressure side liquid-refrigerant passage 42 is connected to the refrigerant outlet of the receiver 3 so that high-pressure side liquid refrigerant is introduced from the receiver 3 into the high-pressure side liquid-refrigerant passage 42. The low-pressure side two-phase refrigerant passage 43 is connected to a refrigerant inlet of the evaporator 5 so that gas-liquid two-phase refrigerant after being decompressed is supplied to the refrigerant inlet of the evaporator 5.

One end of the low-pressure side gas-refrigerant passage 44 is connected to a refrigerant outlet of the evaporator 5, and the other end thereof is connected to a suction side of the compressor 1. Therefore, gas refrigerant evaporated in the evaporator 5 by a heat exchange with air passes through the low-pressure side gas-refrigerant passage 44, and flows into the suction side of the compressor 1. A temperature sensing rod 45 made of a metal such as aluminum, having a sufficient heat conductivity, is disposed to penetrate through the low-pressure side gas-refrigerant passage 44. A valve operation rod 46 is disposed to contact a lower end of the temperature sensing rod 45, and a spherical valve body 47 is disposed to contact a lower end of the valve operation rod 46.

The high-pressure side liquid-refrigerant passage 42 communicates with the low-pressure side two-phase refrigerant passage 43 through a restriction passage 48 for decompressing liquid refrigerant. An opening area of the restriction passage 48 is adjusted by the valve body 47. Accordingly, in this embodiment, a decompression mechanism of the expansion valve 4 is constructed by the spherical valve body 47 and the restriction passage 48.

The temperature sensing rod 45 is formed into a cylindrical shape, and is disposed in the low-pressure side gas-refrigerant passage 44 to sense the temperature of super-heating gas refrigerant evaporated in the evaporator 5.

An upper end side of the temperature-sensing rod 45 contacts a film-like diaphragm 49, and the valve body 47 is biased in a valve-opening direction (i.e., lower side in FIG. 1) of the valve body 47 by the diaphragm 49. The diaphragm 49 is disposed within a diaphragm case 50, so that an inner space of the diaphragm case 50 is partitioned into a first pressure chamber 51 at an upper side of the diaphragm 49 and a second pressure chamber 52 at a lower side of the diaphragm 49.

The diaphragm case 50 is composed of first and second diaphragm casings 50*a*, 50*b* each of which is made of metal and is formed into a predetermined shape by pressing. After an outer peripheral portion of the diaphragm 49 is inserted between the first and second diaphragm casings 50*a*, 50*b*, the first and second diaphragm casings 50*a*, 50*b* are fastened to form an integrated member. Further, the second diaphragm casing 50*b* is screwed into one side end of the body case 41, so that the whole diaphragm case 50 is integrally assembled with the body case 41.

Within the first pressure chamber 51 defined by the diaphragm 49 and the first diaphragm casing 50*a*, the same type refrigerant gas as the refrigerant circulating in the refrigerant cycle is sealingly filled. Accordingly, the temperature of gas refrigerant flowing from the evaporator 5, that is, the temperature of gas refrigerant passing through the low-pressure side gas-refrigerant passage 44, is sensed by the temperature sensing rod 45 and is transmitted to the first pressure chamber 51, and the pressure of the gas refrigerant sealed in the first pressure chamber 51 is changed to correspond to the temperature of the super-heating gas refrigerant at the refrigerant outlet side of the evaporator 5.

On the other hand, the second pressure chamber 52 defined by the diaphragm 49 and the second diaphragm casing 50*b* always communicates with the low-pressure side gas-refrigerant passage 44 through a space 56 provided between the temperature sensing rod 45 and the body case 41, so that the pressure within the second pressure chamber 52 is similar to that of the low-pressure side gas-refrigerant passage 44.

A coil spring 53 is disposed in the high-pressure side liquid-refrigerant passage 42 to be biased in a valve-closing direction of the valve body 47. One end of the coil spring 53 is held in a supporting member 54 for supporting the valve body 47 so that spring force of the coil spring 53 is applied to the valve body 47 through the supporting member 54. The other end of the coil spring 53 is supported by a metal plug 55. The metal plug 55 is disposed to be fixed into a screw hole of the body case 41 so that an attachment position of the metal plug 55 into the screw hole of the body case 41 can be adjusted. By adjusting the attachment position of the metal plug 55 relative to the screw hole of the body case 41, an attachment load of the coil spring 53 can be adjusted.

Accordingly, the valve body 47 is displaced by a balance between the first and second pressure chambers 51, 52 and the force of the coil spring 53 to suitably adjust an opening area (valve opening degree) of the restriction passage 48.

As shown in FIGS. 1–3 and 5, in this embodiment, only a part of the body case 41 and the diaphragm case 50 are covered by a single rubber vibration-proof member 70. For example, the vibration-proof member 70 is made of a butyl rubber having a relatively larger specific gravity and an adhesion.

Figure 4:
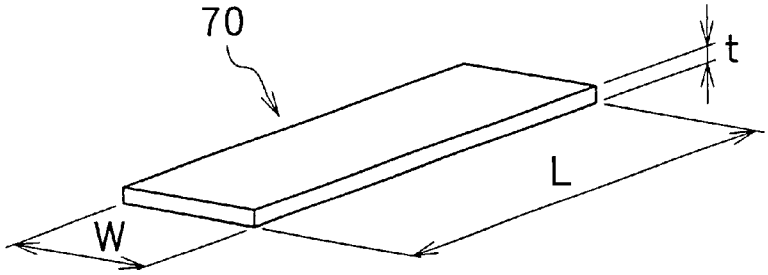
FIG. 4 is a perspective view showing a development shape of a vibration-proof member used in the expansion valve in FIG. 1.

FIG. 4 shows a development shape of the vibration-proof member 70 before being attached onto the expansion valve 4. As shown in FIG. 4, the vibration-proof member 70 before being assembled is formed into a thin rectangular elongated flat plate. For example, when an outer diameter of the diaphragm case 50 is about 40 mm, a width dimension W of the vibration-proof member 70 is set at about 25 mm, and a length L of the vibration-proof member 70 is set at about 80 mm. Further, a thickness t of the vibration-proof member 70 set in a range of 3–3.5 mm. In this embodiment, a removing paper is bonded onto one side surface of the vibration-proof member 70 in a thickness direction, and a film made of a plastic material is bonded onto the other side surface of the vibration-proof member 70 in the thickness direction.

Figure 3:
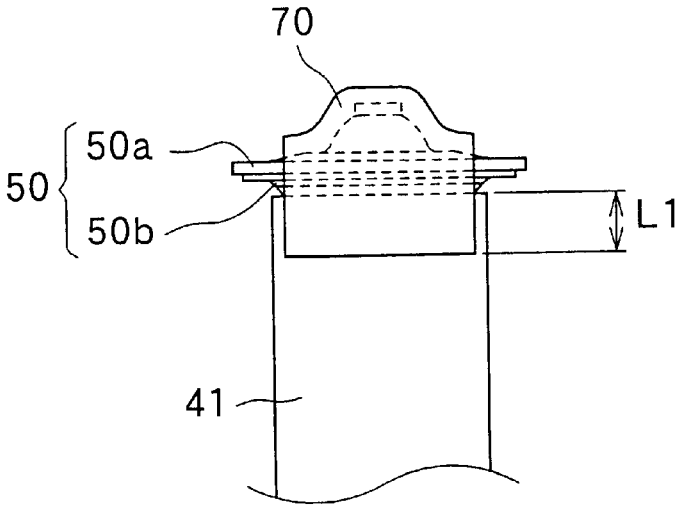
FIG. 3 is a side view showing a part of the expansion valve when being viewed from arrow III in FIG. 2.

After the removing paper of the vibration-proof member 70 is removed, a middle part of the vibration-proof member 70 in the longitudinal direction of the vibration-proof member 70 is bonded onto the first and second diaphragm casings 50*a*, 50*b*, and thereafter, both longitudinal end parts of the vibration-proof member 70 are bonded onto the body case 41. At this time, a bonding length Li between the vibration-proof member 70 and the body case 41 in an up-down direction of FIG. 3 is set at a predetermined length L1 (e.g., about 10 mmm). The vibration-proof member 70 can be bonded to the first and second diaphragm casing 50*a*, 50*b* and the body case 41 by using the itself adhesive performance.

Next, operation of the expansion valve 4 will be now described. When the compressor 1 operates and refrigerant circulates in the refrigerant cycle, the temperature of super-heating gas refrigerant at the outlet of the evaporator 5 within the refrigerant passage 44 is transmitted to the sealed gas within the first pressure chamber 51 through the temperature sensing rod 45. Therefore, the pressure within the first pressure chamber 51 becomes a pressure corresponding to the temperature of super-heating gas refrigerant at the outlet of the evaporator 5 within the refrigerant passage 44, and the pressure within the second pressure chamber 52 becomes the refrigerant pressure in the refrigerant passage 44. Thus, the valve body 47 is displaced based on the pressure difference between both the first and second pressure chambers 51, 52 and the attachment load of the spring 53. Accordingly, the opening degree of the restriction passage 48 is adjusted by the displacement of the valve body 47, and the refrigerant flow amount flowing into the evaporator 5 can be automatically adjusted. That is, by the adjustment of the refrigerant amount, the super-heating degree of gas refrigerant at the outlet of the evaporator 5 can be maintained at a predetermined degree.

Noise is caused around the expansion valve 4 mainly by vibration of the first and second diaphragm casings 50*a*, 50*b*. In this embodiment, the weight of the first and second diaphragm casings 50*a*, 50*b* is increased by the vibration-proof member 70 bonded on the first and second diaphragm casings 50*a*, 50*b*, and the vibration of the first and second diaphragm casings 50*a*, 50*b* is decreased by the weight increase. Further, because the first and second diaphragm casings 50*a*, 50*b* are connected to the body case 41 by the vibration-proof member 70, a freedom vibration of the first and second diaphragm members 50*a*, 50*b* can be restricted. Accordingly, the vibration caused in the first and second diaphragm casings 50*a*, 50*b* can be effectively restricted. As a result, in this embodiment, a noise around 2.5 dB(A) can be effectively reduced, as compared with an expansion valve without a vibration-proof member.

Figure 5:
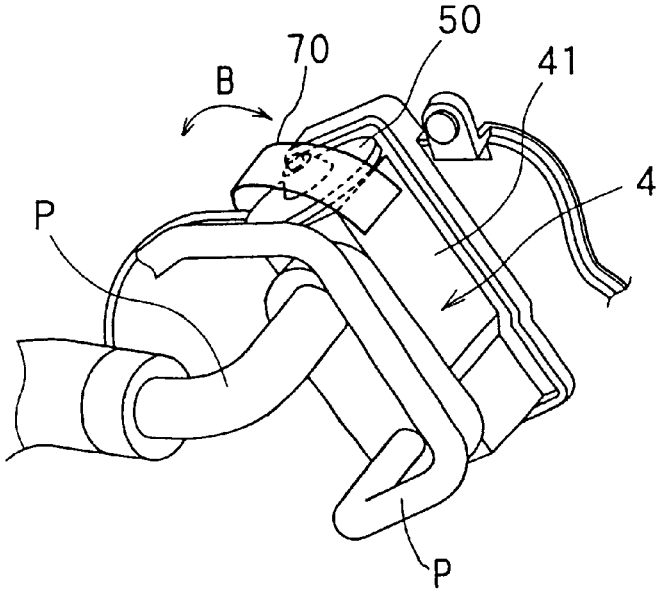
FIG. 5 is a schematic perspective view showing a bonding direction B of the vibration-proof member in the expansion valve, according to the embodiment.
Figure 6:
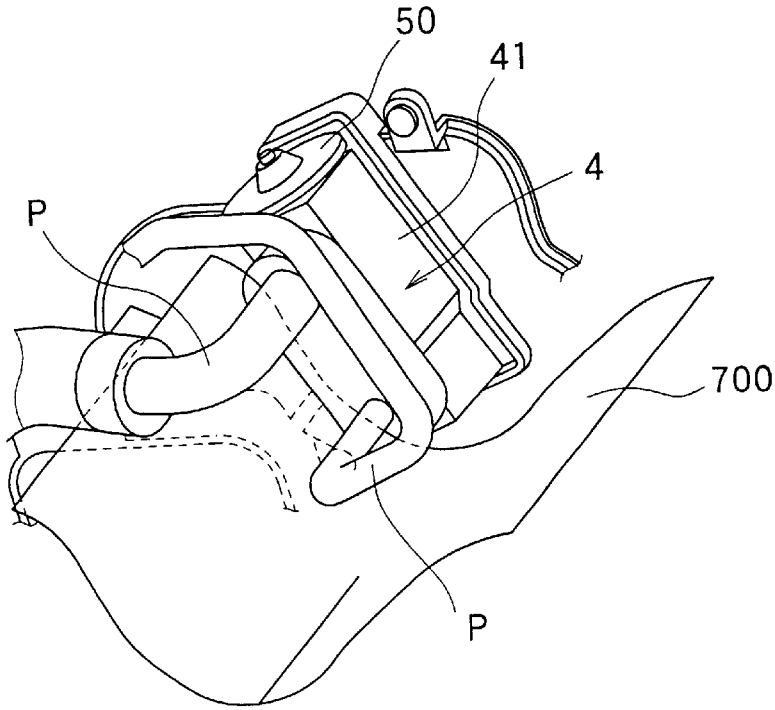
FIG. 6 is a perspective view showing an expansion valve of a comparison example.
Figure 7:
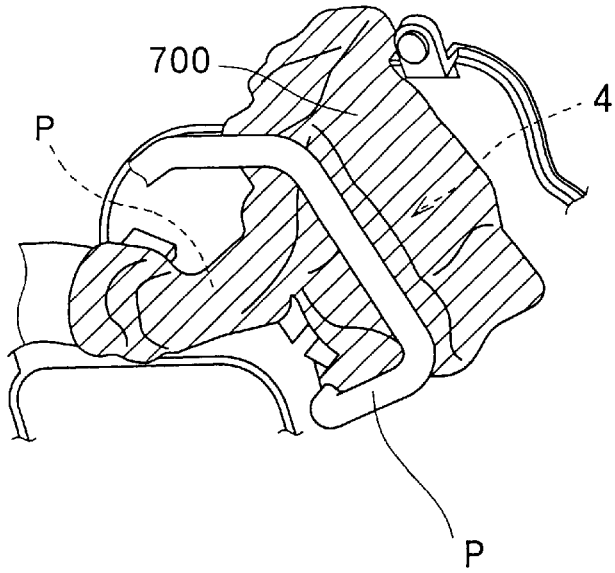
FIG. 7 is a perspective view showing the expansion valve of FIG. 6, after a vibration-proof member is attached.

According to this embodiment of the present invention, a part of the body case 41 and a part of the diaphragm case 50 are covered by the vibration-proof member 70 in a bonding direction B shown in FIG. 5. Therefore, it is compared with a case where a vibration-proof member 700 covers all the expansion valve 4 including a refrigerant pipe P connected to the expansion valve 4 as shown in FIGS. 6 and 7, a dimension (area size) of the vibration-proof member 70 can be greatly reduced, and therefore, a material cost of the vibration-proof member 70 can be greatly reduced. However, according to the experiments of the present inventors, in this embodiment, a reducing effect of noise of 2.5 dB(A), similar to that of FIGS. 6 and 7, is obtained. That is, in this embodiment, the vibration-proof member 70 approximately has the same vibration-restriction effect as that of FIG. 7.

Further, as shown in FIG. 5, in this embodiment, the vibration-proof member 70 is bonded in the bonding direction B shown by the arrow in FIG. 5 to cover a part of the diaphragm case 50 and a part of the body case 41. That is, the vibration-proof member 70 is bonded onto the opposite wall surfaces of the body case 41, where a refrigerant pipe P is not provided. Accordingly, the rectangular vibration-proof member 70 having the width W smaller than that of the body case 41 can be readily bonded in the bonding direction B onto the diaphragm case 51 and the body case 41. Thus, in this embodiment, a detachment operation of the refrigerant pipe P can be readily performed in the expansion valve 4.

In this embodiment, the expansion valve 4 is a box-type expansion valve in which a refrigerant pipe is connected to the body case 41 using a screw member or the like. Accordingly, if the vibration-proof member 700 is disposed to cover all the expansion valve 4 including the refrigerant pipe P as shown in FIGS. 6 and 7, it is difficult to remove the refrigerant pipe P after the vibration-proof member 700 is bonded. Further, in this case, the surface area of the vibration-proof member 700 is increased, and the material cost of the vibration-proof member 700 is increased. However, according to this embodiment, because the vibration-proof member 70 only covers the diaphragm case 50 and a part of the body case 41 in the bonding direction B, the vibration-proof member 70 does not cover the refrigerant pipe P. That is, the vibration-proof member 70 covers the diaphragm case 50 and a part of both side surfaces opposite with each other of the body case 41, in an approximate U-shape. Therefore, in this embodiment, the detachment performance of the refrigerant pipe P is not affected by the vibration-proof member 70, while the material cost of the vibration-proof member 70 is greatly reduced.

On the other hand, if the vibration-proof member 70 only covers the diaphragm case 50, a sufficient vibration-proof effect cannot be obtained, and noise is caused due to vibration in the expansion valve 4. However, according to this embodiment, because the vibration-proof member 70 covers the diaphragm case 50 and a part of the body case 41 with the predetermined length L1, the diaphragm case 41 and the body case 41 are connected by the vibration-proof member 70, and the vibration-proof effect of the vibration-proof member 70 can be effectively improved.

Although the present invention has been fully described in connection with the preferred embodiment thereof with reference to the accompanying drawings, it is to be noted that various changes and modifications will become apparent to those skilled in the art.

For example, in the above-described embodiment, the bonding length L1 between the vibration-proof member 70 and the body case 41 in the up-down direction of the expansion valve 4 is set at about 10 mm. However, the bonding length L1 of the vibration-proof member 70 with the body case 41 can be suitably changed. That is, the bonding length L1 may be shorter than 10 mm, or may be longer than 10 mm.

In the above-described embodiment, the width dimension W of the vibration-proof member 70 can be suitably set to be shorter than the width dimension of the expansion valve 4.

Such changes and modifications are to be understood as being within the scope of the present invention as defined by the appended claims.

What is claimed is:

1. An expansion valve for a refrigerant cycle including an evaporator for evaporating refrigerant, the expansion valve being disposed to adjust an amount of refrigerant flowing into the evaporator, the expansion valve comprising:

a body case having therein a restriction passage for decompressing and expanding high-pressure side liquid refrigerant in the refrigerant cycle;

a valve body, disposed in the body case, for adjusting an opening degree of the restriction passage;

a diaphragm case, disposed at one end side of the body case, for defining therein a first pressure chamber having an inner pressure that changes in accordance with a refrigerant temperature at an outlet side of the evaporator, and a second pressure chamber into which a pressure at the outlet side of the evaporator is introduced;

a diaphragm disposed in the diaphragm case to partition the first pressure chamber and the second pressure chamber in the diaphragm case, and being disposed to displace the valve body in accordance with a pressure difference between both the first and second pressure chambers; and a single vibration-proof member made of a rubber material, and having one side surface to which a part of the diaphragm case is bonded;

wherein the one side surface has two end areas that are bonded to only the body case.

2. The expansion valve according to claim 1, wherein the vibration-proof member has an elongated shape having a width dimension and a longitudinal dimension; and two end side parts of the vibration-proof member in a longitudinal direction define the two end areas bonded to only the body case, and a middle part between the two end side parts of the vibration-proof member is bonded to the diaphragm case.

3. The expansion valve according to claim 2, wherein:

the body case has a width dimension in a direction corresponding to the width of the vibration-proof member; and the width of the vibration-proof member is within the width dimension of the body case.

4. The expansion valve according to claim 1, wherein the vibration-proof member is made of a butyl rubber.

5. The expansion valve according to claim 1, wherein:

the body case has an approximate box shape, and is connected to a refrigerant pipe through which refrigerant flows;

the refrigerant pipe is connected to the body case at one side in a width direction;

the diaphragm case is disposed at one side end of the body case in an extending direction of the body case, approximately perpendicular to the width direction; and the vibration-proof member is disposed to be bonded onto the diaphragm case and a part of side surfaces of the body case in a direction approximately perpendicular to the width direction and the extending direction of the body case.

6. The expansion valve according to claim 1, wherein the diaphragm case is disposed at an upper side end of the body case.

7. The expansion valve according to claim 6, wherein the vibration-proof member is disposed to cover an upper surface of the diaphragm case and both side surfaces of the body case, opposite with each other, in an approximate U shape.

8. The expansion valve according to claim 1, wherein:

the body case has an approximate box shape; and the vibration-proof member is disposed to be bonded in a bonding direction extending from one of opposite surfaces of the body case to the other one of the opposite surfaces through one side surface of the diaphragm case.

9. The expansion valve according to claim 1, wherein the diaphragm case is disposed to be connected to the body case by the vibration-proof member.

10. The expansion valve according to claim 1, wherein the two end areas of the one side surface of the vibration-proof member are predetermined areas from opposite ends of the one side surface.

11. An expansion valve for a refrigerant cycle including an evaporator for evaporating refrigerant, the expansion valve being disposed to adjust an amount of refrigerant flowing into the evaporator, the expansion valve comprising:

a body case having therein a restriction passage for decompressing and expanding high-pressure side liquid refrigerant in the refrigerant cycle, said body case defining an outer surface extending in a longitudinal direction of the body case;

a valve body, disposed in the body case, for adjusting an opening degree of the restriction passage;

a diaphragm case, disposed at one end side of the body case, for defining therein a first pressure chamber having an inner pressure that changes in accordance with a refrigerant temperature at an outlet side of the evaporator, and a second pressure chamber into which a pressure at the outlet side of the evaporator is introduced;

a diaphragm disposed in the diaphragm case to partition the first pressure chamber and the second pressure chamber in the diaphragm case, and being disposed to displace the valve body in accordance with a pressure difference between both the first and second pressure chambers; and a single vibration-proof member made of a rubber material, and being disposed to cover only a part of the body case and the diaphragm case, the single vibration-proof member defining a covered area and a non-covered area of the outer surface of the body case, a portion of the non-covered area of the outer surface extending over the entire longitudinal direction of the body case.

12. The expansion valve according to claim 11 wherein the body case defines a passage extending through the non-covered area of the outer surface of the body case and the expansion valve further comprises a refrigerant pipe connected to the body case in communication with the passage.

* * * * *